US005229542A

United States Patent [19]

Bryan et al.

[11] Patent Number: 5,229,542

[45] Date of Patent: Jul. 20, 1993

[54] SELECTABLE FRAGMENTATION WARHEAD

[75] Inventors: Courtney S. Bryan, Los Alamos; Dennis L. Paisley, Santa Fe; Nelson I. Montoya, Espanola; David B. Stahl, Los Alamos, all of N. Mex.

[73] Assignee: The United States of America as represented by the United States Department of Energy, Washington, D.C.

[21] Appl. No.: 858,744

[22] Filed: Mar. 27, 1992

[51] Int. Cl.[5] ..... F42B 12/22; F42C 19/00

[52] U.S. Cl. ..... 102/491; 102/201; 102/473; 102/475; 102/478; 102/492

[58] Field of Search ..... 102/201, 305, 306, 308, 102/473, 475, 476, 478, 479, 491, 492, 493

[56] References Cited

U.S. PATENT DOCUMENTS

| | | | |
|---|---|---|---|
| 3,812,783 | 5/1974 | Yang | 102/201 |
| 4,711,181 | 12/1987 | Ringel et al. | 102/476 |
| 4,784,062 | 11/1988 | Rudolf et al. | 102/476 |
| 4,862,802 | 9/1989 | Streifer et al. | 102/201 |
| 4,917,014 | 4/1990 | Loughry et al. | 102/201 |
| 5,029,528 | 7/1991 | Paisley | 102/201 |
| 5,078,069 | 1/1992 | August et al. | 102/476 |

FOREIGN PATENT DOCUMENTS

| | | | |
|---|---|---|---|
| 2170888 | 8/1986 | United Kingdom | 102/476 |

*Primary Examiner*—Harold J. Tudor

*Attorney, Agent, or Firm*—Milton D. Wyrick; Paul D. Gaetjens; William R. Moser

[57] ABSTRACT

A selectable fragmentation warhead capable of producing a predetermined number of fragments from a metal plate, and accelerating the fragments toward a target. A first explosive located adjacent to the plate is detonated at selected number of points by laser-driven slapper detonators. In one embodiment, a smoother-disk and a second explosive, located adjacent to the first explosive, serve to increase acceleration of the fragments toward a target. The ability to produce a selected number of fragments allows for effective destruction of a chosen target.

3 Claims, 3 Drawing Sheets

SELECTABLE FRAGMENTATION WARHEAD

BACKGROUND OF THE INVENTION

The present invention generally relates to missile warheads and, more specifically, to warheads which can be fragmented into a desired number of fragments for a particular target. The invention is a result of a contract with the Department of Energy (Contract No. W-7405-ENG-36).

Recently, sensor technology has progressed to the point where a warhead or missile can not only acquire their own targets, but can also distinguish between so-called "hard" and "soft" targets. This ability would be of great benefit if the warhead could configure itself to achieve the greatest efficiency for a particular target, that is, to produce the size and number of fragments most effective for the given situation. For example, a "smart" missile could determine the nature of the target and, if a tank, form a single fragment; if an armored personnel carrier, form three fragments; if a radar van, form five fragments; and if personnel, form seven or more fragments.

Although fragmentation weapons, such as the fragmentation grenade, have existed for decades, the number of fragments produced has never been selectable. Such devices are made by machining or scoring the metal plate so that an explosion will separate the plate into the desired fragments. There is then no possibility of selecting a certain number or size of fragments.

Although efforts have been made to control fragmentation through the use of electrically driven slapper plates, these efforts have not yet been successful. To accomplish this with slapper plates, many circuits would be required, greatly complicating the system. Also, slapper plates may be susceptible to electrical interference.

The present invention overcomes these problems through use of fiber optics to initiate explosives in such a way as to launch the desired number of fragments from the metal plate.

With fiber optics, which are not affected by electrical interference, the number of fragments can be selected by the electronics of a warhead, tailored for a particular target.

It is therefore an object of the present invention to provide a fragmentation warhead which allows for selecting the number of fragments to be projected.

It is another object of the present invention to provide a fragmentation warhead that is not susceptible to interference from electrical disturbances.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention comprises a metal plate with a castable explosive located adjacent to the plate. Three or more of laser-driven slapper detonators are located at selected positions adjacent to the castable explosive effective to produce a selected number of fragments from the metal plate. A laser is connected to the plurality of laser-driven slapper detonators through optical switches for selectable detonation of the castable explosive from the plurality of laser-driven slapper detonators.

In a further aspect of the present invention, and in accordance with its objects and purposes, a selectable fragmentation warhead comprises a case having proximal and distal ends with a fragmenting plate mounted in said distal end of said casing. First explosive means are cast adjacent to the fragmenting plate for creating and accelerating a predetermined number of fragments from the fragmenting plate. Three or more of first laser-driven slapper detonators are located adjacent to the first explosive means for detonating the first explosive means in a predetermined pattern. Smoother-disk means are located adjacent to the first explosive means for increasing the acceleration of the fragments. Second explosive means are cast adjacent to the smoother-disk means for further accelerating the fragments. One or more laser-driven slapper detonators are located in the second explosive means. A laser is located in the proximal end of the casing, and optical fibers connect the laser to the first and second laser-driven slapper detonators. Optical switch means located in series with the optical fibers connected to the plurality of first laser-driven slapper detonators block or pass light from the laser to the plurality of first laser-driven slapper detonators.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

Figure 1:
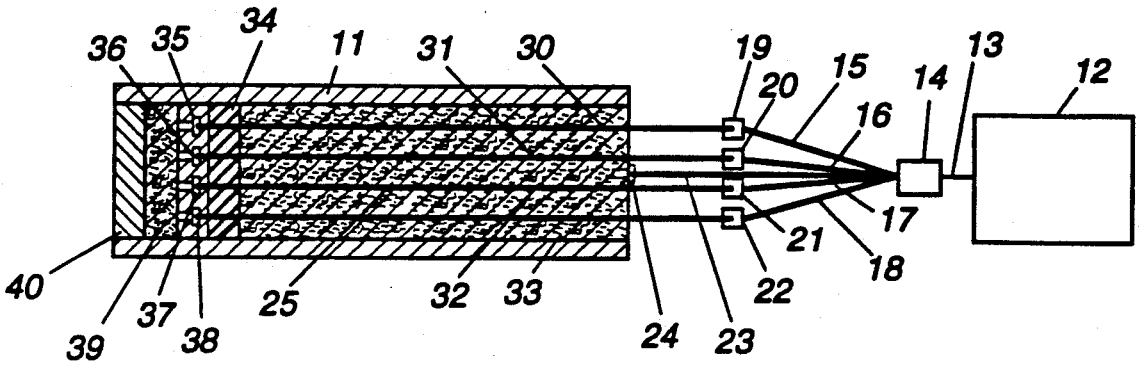
FIG. 1 is a schematic representation of one embodiment of a warhead capable of firing a predetermined number of metal fragments.

The present invention provides a system for producing selectable fragmentation from a warhead through the use of fiber optics and laser-driven slapper detonators. One embodiment is shown in schematic form in FIG. 1. Here, warhead 10 contains laser 12 connected by optical fiber 13 to fiber-optic bundle 14. Fiber-optic bundle 14 distributes the light from laser 12 through optical fibers 15, 16, 17 and 18 to series Q-switches 19, 20, 21 and 22. Fiber-optic bundle 14 also outputs light from laser 12 through optical fiber 23 to laser-driven slapper detonator 24, which is to detonate cast main charge 25.

Q-switches 19, 20, 21 and 22 are connected to optical fibers 30, 31, 32 and 33, respectively. Optical fibers 30, 31, 32 and 33 extend through cast main charge 25 and through Lucite® smoother-disk 34, and terminate at laser-driven slapper detonators 35, 36, 37 and 38, respectively, adjacent to cast fragmenting charge 39. Cast fragmenting charge 39 is cast between Lucite smoother-disk 34 and fragmenting plate 40. All of this is contained within warhead case 11.

Q-switches 19, 20, 21 and 22 are electrically controlled optical block switches, and are commercially available from Cleveland Crystal, Inc., P.0. Box 17157, Cleveland, Ohio 44117. Q-switches 19, 20, 21 and 22, being in series, operate to either block or pass light from laser 12, allowing for a predetermined firing pattern of laser-driven slapper detonators 35, 36, 37 and 38. If only one fires, the entire fragmenting plate 40 is launched. If all four fire, plate 40 is fragmented into four fragments. The application of Q-switches 19, 20, 21 and 22 provides a further benefit as a safe-and-arming mechanism by setting Q-switches 19, 20, 21 and 22 so that only a specific voltage signal would open them.

Lucite® smoother-disk 34, in cooperation with cast main charge 25, serves to increase the velocity of fragments of fragmenting plate 40. With the proper length of cast main charge 25, and initiating cast main charge 25 and cast fragmenting charge 39 simultaneously (disregarding propagation time to laser-driven slapper detonators 35, 36, 37 and 38), fragmenting plate 40 will cleave and separate, and the fragments produced will be accelerated by the detonation front produced by cast main charge 25, in addition to that from cast fragmenting charge 39. The proper length of cast main charge 25 is determined from the burn time of the particular charge used, so that the detonation front from cast main charge 25 arrives at fragmenting plate while the fragments are being projected, but are still close together. With the correct height of cast fragmenting charge 39 chosen to produce in-plane tensile failure along shock interaction lines, proper cutting and sizing of fragments from fragmenting plate 34 is attained.

Information on calculating the proper length of cast main charge 25 and the correct height for cast fragmenting charge 39 can be found in a paper entitled "Gurney Energy of Explosives: Estimation of the Velocity and Impulse Imparted to Driven Metal," by J. E. Kennedy, Paper No. SC-RR-70-790, Sandia National Laboratory, Albuquerque, N. Mex. 87115, December, 1970. This paper is to be considered to be included herein for all purposes.

Figure 3:
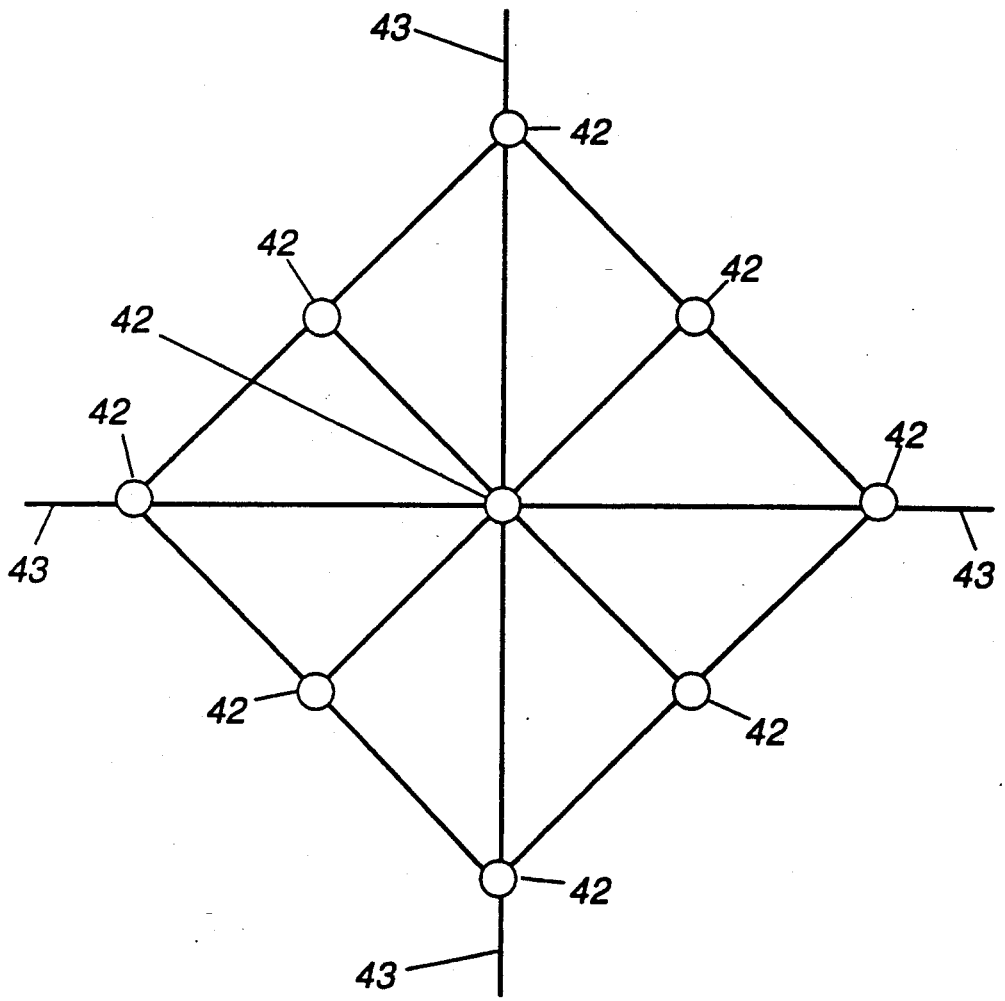
FIG. 3 is an illustration of one method of suspending nine laser-driven slapper detonators inside the fragmenting charge of a warhead.

Reference should now be made to FIG. 3, where frame 41 is illustrated holding nine laser-driven slapper detonators 42. Frame 41 can be made of wire or thin metal, and attaches to a warhead case such as case 11 (FIG. 1) through connectors 43. Of course, this is only one of many possible configurations for maintaining laser-driven slapper detonators 42 at desired locations adjacent to cast fragmenting charge 39 (FIG. 1).

Figure 2:
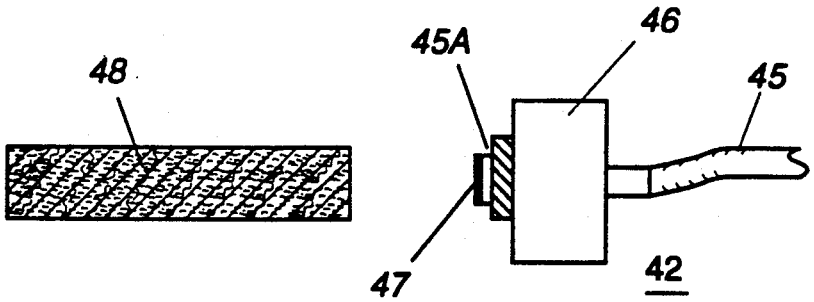
FIG. 2 is a plan view of a typical laser-driven slapper detonator.

In FIG. 2, a side view of a typical laser-driven slapper detonator 42 is illustrated. This type of laser-driven slapper is fully described in U.S. Pat. No. 5,029,528, issued Jul. 9, 1991, to Paisley. Reference to this patent for details is suggested. However, for purposes of the present invention, laser-driven slapper detonator 42 comprises optical fiber 45 terminating in fiber-optic connector 46, a conventional fiber-optic connector. End 45*a* of optical fiber 45 is covered by metal flyer plate 47. Metal flyer plate 47 is placed on end 45*a*, and may be a single layer of a metal such as aluminum, in a thickness sufficient for accomplishing the desired detonation of explosive 48.

As disclosed in the above-referenced patent, when there is a need for a plate 47 to have higher energies, metal flyer plate 47 may comprise a first layer of metal, a layer of a dielectric material and an outer layer of metal (not shown). This allows the first layer to provide the material for plasma formation, allowing the entire mass of the outer layer to be launched toward explosive 48.

Figure 4:
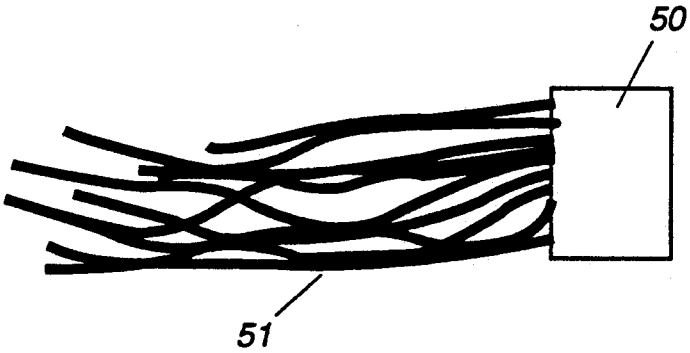
FIGS. 4 and 5 illustrate side and front views, respectively, of a fiber-optic bundle according to the present invention.
Figure 5:
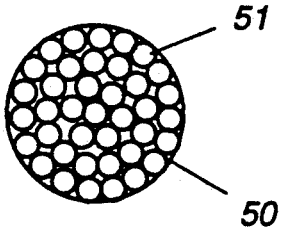

Reference should now be made to FIGS. 4 and 5, where side and front views, respectively, of fiber-optic bundle 14 are illustrated. As seen, fiber-optic bundle 14 comprises collar 50 for maintaining the proximal ends of optical fibers 51 in a desired configuration. A connector connects optical fiber 13 (FIG. 1) to collar 50 so that the light energy from laser 12 is distributed in substantially equal portions among optical fibers 51. The distal ends of optical fibers 51 are connected to individual laser-driven slapper detonators 42.

Referring back to FIG. 1, the explosives used as cast main charge 25 and cast fragmenting charge 39 may be any castable explosive suitable for the intended purpose. One such explosive is PBXW-113.

The present invention can be configured to fire numerous fragmentation patterns. This ability, with the use of target identification and classification sensor technology, allows the invention to engage a target with the highest kill probability. Additionally, the use of laser initiation and optical fibers renders the invention safe from electromagnetic disturbances and from most forms of sabotage.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A selectable fragmentation warhead comprising:

a case having proximal and distal ends;

a fragmenting plate mounted in said distal end of said casing;

first explosive means cast adjacent to said fragmenting plate for creating a predetermined number of fragments from said fragmenting plate;

three or more first laser-driven slapper detonators located adjacent to said first explosive means for detonating said first explosive means in a predetermined pattern;

smoother-disk means located adjacent to said first means for accelerating said fragments;

second explosive means cast adjacent to said smoother-disk means for further accelerating said fragments;

at least one laser-driven slapper detonators located in said second explosive means;

a laser located in said proximal end of said casing;

optical fibers connecting said laser to said first and second laser-driven slapper detonators; and optical switch means located in series with said optical fibers connected to said plurality of first laser-driven slapper detonators for blocking or passing light from said laser to said plurality of first laser-driven slapper detonators.

2. The warhead as described in claim 1, wherein said castable explosive comprises PBXW-113 explosive.

3. The warhead as described in claim 2, wherein said optical switches comprise Q-switches.

* * * * *